US009127456B2

(12) United States Patent
Dollerup et al.

(10) Patent No.: US 9,127,456 B2
(45) Date of Patent: Sep. 8, 2015

(54) OUTER RAIL FOR WALL PLATE COVERING

(75) Inventors: Kristian Dollerup, Menzinger (CH); Niels Dollerup, Esbjerg (DK)

(73) Assignee: ZAK-IT SYSTEMS GMBH, Menzingen (CH)

( * ) Notice: Subject to any disclaimer, the term of this patent is extended or adjusted under 35 U.S.C. 154(b) by 0 days.

(21) Appl. No.: 13/991,862

(22) PCT Filed: Sep. 12, 2011

(86) PCT No.: PCT/DK2011/050340

§ 371 (c)(1), (2), (4) Date: Aug. 19, 2013

(87) PCT Pub. No.: WO2012/076011

PCT Pub. Date: Jun. 14, 2012

(65) Prior Publication Data

US 2013/0333321 A1 Dec. 19, 2013

(30) Foreign Application Priority Data

Dec. 6, 2010 (DK) ..... 2010 70531

(51) Int. Cl.
*E04C 3/02* (2006.01)
*E04C 3/00* (2006.01)
(Continued)

(52) U.S. Cl.
CPC ..... *E04C 3/00* (2013.01); *E04B 2/7457* (2013.01); *E04B 2/764* (2013.01); *E04B 2/767* (2013.01); *E06B 3/988* (2013.01); *E06B 2003/7074* (2013.01)

(58) Field of Classification Search
CPC ..... E04B 2/767; E04B 2/7457; E04B 2001/2448; E04B 2/789; E04B 2/58; E04B 2001/2409; E04B 1/5818; E04B 9/26; E04C 3/07; E04C 2003/0473; E04C 3/32; E06B 3/988; E06B 2003/7074; E06B 3/9684
USPC ..... 52/841.2, 92.1, 408, 762, 238.1, 241, 52/481.1, 290
See application file for complete search history.

(56) References Cited

U.S. PATENT DOCUMENTS 2,451,396 A * 10/1948 Macleod ..... 52/455
2,902,166 A * 9/1959 Bahr ..... 211/11
(Continued)

FOREIGN PATENT DOCUMENTS

DE 4242544 A1 7/1994
EP 1267008 A2 12/2002
(Continued)

OTHER PUBLICATIONS

International Search Report issued in PCT Patent Application PCT/DK2011/050340 dated Nov. 18, 2011, 4 pages.

*Primary Examiner* — Phi A
*Assistant Examiner* — Omar Hijaz
(74) *Attorney, Agent, or Firm* — Lathrop & Gage LLP

(57) ABSTRACT

The outer rail retains two lateral screw webs of an intermediate rail to construct a base for wall plate covering. Two retention devices are disposed oppositely on respective inner sides of each retention web for retaining a respective screw web of the intermediate rail. Each retention device including an abutment part, which extends inwards from the inner side of the retention web such as to form an abutment surface for the respective screw web when the latter is positioned to be retained in the retention device, and extends from the abutment part into a locking part, which extends at an angle to the abutment part and at a distance from the respective retention web. Each locking part comprising a first resilient locking pin adapted to lock a first screw web configuration and a second, separate resilient locking pin adapted to lock a second screw web configuration, the first and second screw web configurations being pre-defined and different from each other. Hereby, different screw web configurations can be attached to the same retention web.

13 Claims, 9 Drawing Sheets

(51) Int. Cl.

| | |
|---|---|
| ***E04B 7/04*** | (2006.01) |
| ***E04B 5/00*** | (2006.01) |
| ***E04B 2/00*** | (2006.01) |
| ***E04B 2/74*** | (2006.01) |
| ***E04B 2/76*** | (2006.01) |
| *E06B 3/988* | (2006.01) |
| *E06B 3/70* | (2006.01) |

(56) References Cited

U.S. PATENT DOCUMENTS

| | | | | | |
|---|---|---|---|---|---|
| 3,536,345 | A | | 10/1970 | Leifer | |
| 3,680,271 | A | | 8/1972 | Satchell | |
| 3,720,995 | A | | 3/1973 | Evans et al. | |
| 3,845,601 | A | * | 11/1974 | Kostecky | 52/290 |
| 3,989,399 | A | | 11/1976 | Slowbe | |
| 4,193,245 | A | * | 3/1980 | Johnson | 52/656.4 |
| 4,235,054 | A | | 11/1980 | Cable et al. | |
| 4,805,364 | A | | 2/1989 | Smolik | |
| 4,854,096 | A | | 8/1989 | Smolik | |
| 5,157,883 | A | * | 10/1992 | Meyer | 52/357 |
| 5,222,335 | A | | 6/1993 | Petrecca | |
| 5,274,973 | A | * | 1/1994 | Liang | 52/243 |
| 5,325,651 | A | | 7/1994 | Meyer et al. | |
| 5,394,665 | A | | 3/1995 | Johnson | |
| 5,408,796 | A | * | 4/1995 | Hashimoto et al. | 52/489.2 |
| 5,720,138 | A | | 2/1998 | Johnson | |
| 5,797,233 | A | | 8/1998 | Hascall | |
| 6,079,181 | A | | 6/2000 | Ruff | |
| 6,279,289 | B1 | | 8/2001 | Soder et al. | |
| 6,301,854 | B1 | * | 10/2001 | Daudet et al. | 52/650.1 |
| 6,374,558 | B1 | * | 4/2002 | Surowiecki | 52/241 |
| 6,397,550 | B1 | * | 6/2002 | Walker et al. | 52/653.1 |
| 6,647,691 | B2 | | 11/2003 | Becker et al. | |
| 6,983,569 | B1 | | 1/2006 | Rosenberg | |
| 7,216,465 | B2 | | 5/2007 | Saldana | |
| 7,640,701 | B2 | * | 1/2010 | Rutherford | 52/243 |
| 7,770,348 | B2 | | 8/2010 | Tollenaar | |
| 7,779,593 | B2 | * | 8/2010 | Jahn et al. | 52/506.06 |
| 7,975,448 | B2 | | 7/2011 | Jahn et al. | |
| D646,559 | S | * | 10/2011 | Near | D8/384 |
| 8,333,049 | B2 | * | 12/2012 | Badger | 52/784.13 |
| 2002/0020140 | A1 | * | 2/2002 | Sucre | 52/733.2 |
| 2006/0010811 | A1 | | 1/2006 | Platt | |
| 2007/0011971 | A1 | | 1/2007 | Sitkiewicz | |
| 2007/0119843 | A1 | | 5/2007 | Ball | |
| 2008/0168733 | A1 | * | 7/2008 | Tollenaar | 52/481.1 |
| 2009/0133356 | A1 | | 5/2009 | Zadeh | |
| 2011/0146180 | A1 | * | 6/2011 | Klein | 52/317 |

FOREIGN PATENT DOCUMENTS

| | | | | |
|---|---|---|---|---|
| GB | 1468190 | A | | 3/1977 | |
| GB | 2275280 | A | | 8/1994 | |
| WO | 2007136368 | A | | 11/2007 | |
| WO | 2009106083 | A2 | | 9/2009 | |
| WO | WO 2009106083 | A2 | * | 9/2009 | E04B 2/74 |

* cited by examiner

OUTER RAIL FOR WALL PLATE COVERING

RELATED APPLICATION

This application is a U.S. 371 National Phase Application of PCT/DK2011/050340, filed Sep. 12, 2011 which claims priority to Danish Patent Application PA 2010 70531 filed Dec. 6, 2010.

BACKGROUND OF THE INVENTION

The present invention relates to an outer rail for attaching two lateral retention webs of an intermediate rail to construct a base for wall plate covering.

Such bases form a framework for wall plate covering and may today find application in both non-bearing and bearing walls, and both interior and exterior walls. However, this type of walls traditionally serves as partition or room divider. It may be provided with doors or windows. As plate covering plaster or gypsum boards are often used. The boards are typically coated with a cardboard layer contributing to distribution of surface tensions such that the porous board can be handled on the construction site and be screwed onto the underlying construction without breaking. These boards are typically produced with widths of 900 mm or 1200 mm.

Prior art rail systems for constructing a base for wall plate covering typically comprise two kinds of elements, namely outer rails and intermediate rails. The outer rails extend in a longitudinal direction and have a U-shaped cross section formed by a transverse connecting part connecting two opposed lateral retention webs. The intermediate rails often have a C-shaped cross section with two lateral screw webs.

When mounting the base the outer rails are typically fastened along ceiling and floor with the "openings" of the outer rails facing each other. An outer rail is therefore frequently used along the floor and correspondingly along the ceiling. The intermediate rails are then placed vertically between the outer rails and are attached to the outer rails at top and bottom. Subsequently, insulation may be mounted between the intermediate rails, and the plates or boards can be mounted by means of insertion of self-tapping screws through the plates and into the screw webs and/or retention webs of the intermediate and outer rails. It is also possible to attach the boards or plates with glue.

A multitude of methods for attaching the intermediate rails to the outer rails are known in the prior art. In the most widespread method the distance between the intermediate rails is set out by markings on each of the top and bottom outer rails. The markings are drawn by a workman after having made suitable measurements. Then the intermediate rails are positioned between the outer rails, after which they are attached by means of fixing tongs that cut a collared hole through both sections. A number of drawbacks are associated with this method. Most noteworthy, the modular dimensions between the intermediate rails may easily deviate, whereby the associated plate cannot be screwed on the intermediate rails with the required exact dimensions from screws to plate edge. Further, the connections between the rails are of unsatisfactory strength so that the self-tapping screws often do not get hold of the screw webs or retention webs, especially at the end parts of the intermediate rails. Also, the method is time-consuming and troublesome.

EP 1267008 A discloses an outer rail with a strip-formed retention device or tongue, which has been cut out from the outer rail. The tongue extends inclined from the retention web of the outer rail. An intermediate rail comprises a lateral screw web that extends into a flange extending inwards from a distal end of the screw web. The tongue comprises at a central part a curvature forming a depression into which the flange slides to attach the latter by means of resilience of the retention device.

Other examples of prior art rail systems are found in WO 2009/106083 A, U.S. Pat. No. 3,680,271 and U.S. Pat. No. 3,720,995.

On this background the object of the invention is to provide a cost-effective, stable and flexible outer rail design for use in system for constructing a base for wall plate covering that can be rapidly mounted.

BRIEF SUMMARY OF THE INVENTION

According to the present invention, this object is achieved with the provision of an outer rail according to claim 1.

With the outer rail of the present invention several different types of intermediate rail can be attached to one and the same outer rail. The two different locking pins of each locking part thus make it possible to apply or insert at least two different screw web configurations of an intermediate rail to the outer rail. The two different screw web configurations may be provided as the respective two screw webs of a single intermediate rail. They may also be provided as a first intermediate rail type having mutually similar screw webs of a first configuration and a second intermediate rail type having mutually similar screw webs of a second configuration. A rail system using the outer rail of the present invention can thus surprisingly use both symmetric and asymmetric types of intermediate rails with one and the same outer rail. Further, the retention device can be dimensioned to fit most of the widely used intermediate rails on the market and provides more freedom in the design of intermediate rails, e.g. with respect to shape optimization with regards to transport or telescoping rails.

The retention devices of the outer rail are simple in construction and cost-effective in manufacture. Since the rails may be clicked or snapped together, much time is saved during mounting of the resulting wall plate base, and working conditions including work positions are improved. Also, fewer errors are likely to occur during mounting.

Retention of the intermediate rail is strong and stable so that the overall quality of the resulting plate wall is improved.

Dependent claims define preferred embodiments.

In one preferred embodiment the abutment part and locking part of each retention device are formed as a cut-out from the retention web, the abutment part being integral with the retention web and bending inwards from a proximal end, and at a distal end bending in the longitudinal direction to extend integrally into the locking part, the abutment part preferably extending inwards substantially at a right angle to the retention web, and the locking part extending substantially at a right angle to the abutment part, i.e. substantially in the longitudinal direction. The abutment part extending inwards substantially at a right angle to the retention web has the effect of providing much better ability to absorb tensile forces in the orthogonal or inwards direction. When subsequently inserting screws through a wall plate such as a plaster board, the inwards directed forces from the screw exerted on the screw web of the intermediate rail will thus be less likely to push out the screw web from the retention to the retention web of the outer rails since these forces are absorbed by means of an opposite tensile force with a point of attack projected at a right angle onto the retention web of the outer rail.

In another preferred embodiment the two locking pins of each locking part are formed as tongues cut out in a flange of the locking part, each tongue being integral with the flange at a proximal end and bending from the proximal end such that each tongue forms an acute angle with the flange and extends in an inclined direction towards the abutment part. This is a cost-efficient, effective and reliable way of ensuring that the screw web of the intermediate rail can easily be slid into the attached position.

In another preferred embodiment, for each retention device a distal end of the first locking pin is positioned near the abutment part such as to be adapted to attach an inwards extending flange of a first screw web configuration of an associated intermediate rail between the distal end of the first locking pin and the abutment part, and a distal end of the second locking pin is formed by an abutment portion that is bend inwards and positioned at a greater distance from the abutment part such as to be adapted to attach a flange extending in the longitudinal direction from an inwards extending flange of a second screw web configuration of an associated intermediate rail between the abutment portion and the abutment part, preferably the abutment portion in the initial position of the second locking pin extends substantially linearly to form a substantially right angle with the flange of the locking part. Hereby, two ordinary types of intermediate rail designs can be attached to one and the same retention device of each of the two retention webs of the outer rail.

In another preferred embodiment the first and second locking pins of each locking part are positioned above each other, i.e. at different distances from the connecting part.

In another preferred embodiment each locking part comprises two preferably separate locking part portions, each extending in opposite directions from the abutment part and comprising one of the first and second locking pins, each abutment part preferably also comprising two preferably separate abutment part portions, each abutment part portion being associated with one locking part portion, more preferred the abutment part portions are coplanar and positioned above each other in a direction away from the connecting part and/or the retention device comprises two separate portions, each having an abutment part portion and a locking part portion. Hereby, an intermediate rail with suitable asymmetrical cross section, i.e. different designs of its two screw webs fitting the two different locking pins of the two different respective locking part portions, can be snapped into attachment with the outer rail. In a further development of this embodiment each locking part portion forms part of an associated retention device portion, which is formed as a separate cut-out from the respective retention web.

The invention also comprises according to claim 8 applying the outer rail of the invention to a sectional rail system for constructing a base for plate covering, the sectional rail system further comprising an intermediate rail extending in a substantially linear direction and having a C-shaped cross section formed by a transverse connecting portion connecting two opposed lateral screw webs, both screw web comprising a first flange connected to the connecting portion and adapted to abut the respective retention web of the outer rail in the longitudinal direction when the intermediate rail is attached to the outer rail, and a second flange extending inwards from and preferably substantially orthogonally to the first flange.

In a further developed embodiment of the sectional rail system one screw web has a first pre-defined configuration and the other has a second predefined configuration, the second configuration being different from the first configuration, this preferably being realized so that only the second screw web configuration further comprises a third flange extending from the second flange in the longitudinal direction and preferably substantially orthogonally to the second flange such that the first, second and third flanges of the second screw web configuration form a U-shape.

In another preferred embodiment of the sectional rail system an end flange of each of the first, second and third flanges of each screw web comprises a cut-out, the cut-outs being positioned at a distance from the bottom of the intermediate rail to correspond in a height direction to the respective retention devices of the outer rail when attached to the outer rail so that when attached the intermediate rail is also secured in the height direction.

BRIEF DESCRIPTION OF THE DRAWINGS

The invention will be explained below with reference to the accompanying drawings, wherein.

DETAILED DESCRIPTION OF THE INVENTION

In the figures identical, similar or like elements of different embodiments are denoted with identical reference numbers.

Figure 1:
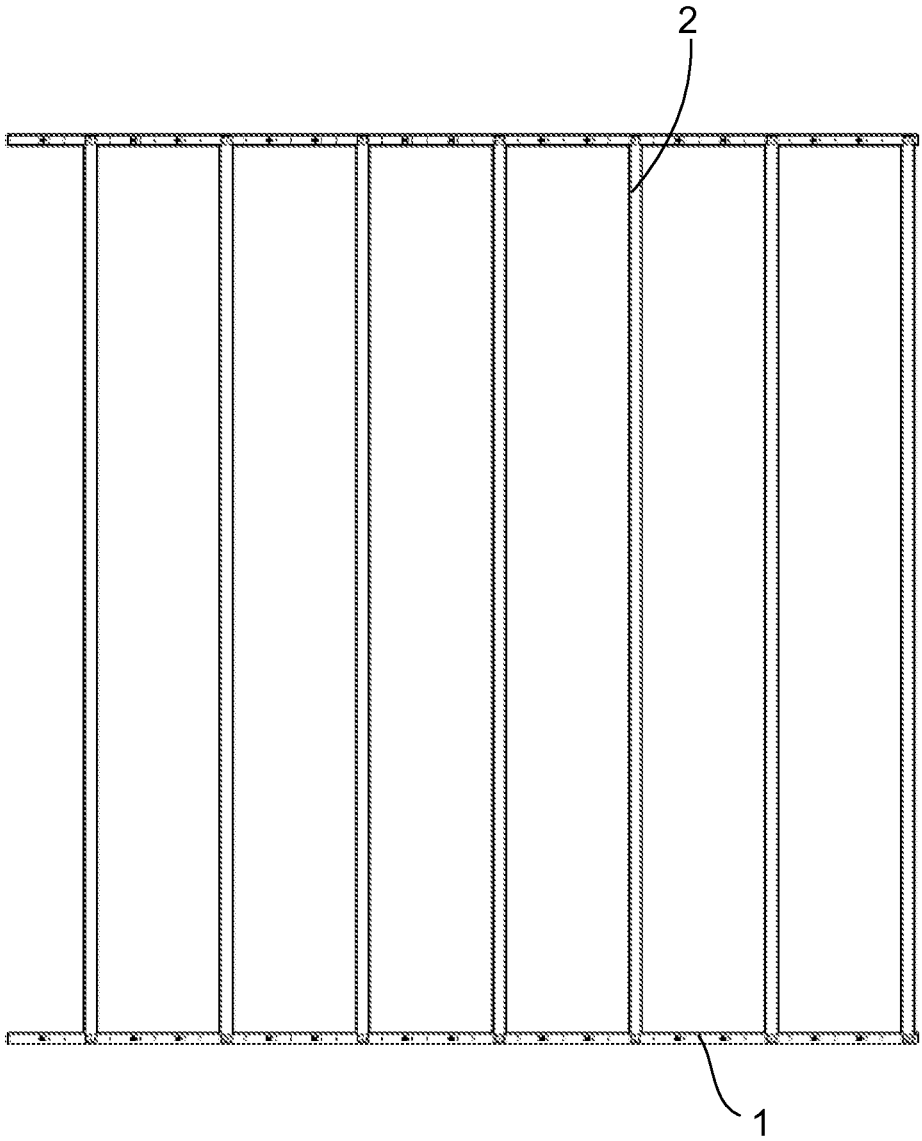
FIG. 1 is a front view of an assembled base for wall plate mounting comprising seven intermediate rails as well as two outer rails.

FIG. 1 shows an example of an assembled base for wall plate mounting comprising seven intermediate rails as well as two outer rails. FIGS. 2 to 8 show different details of a first embodiment of an outer rail 1 and an intermediate rail 2 of FIG. 1. The remaining rails of the base are similar to the rails 1 and 2.

When mounting the base of FIG. 1 using the embodiment of the rails 1 and 2 according to FIGS. 2 to 8 generally the horizontally positioned outer rails are fastened along ceiling and floor with the openings of the outer rails facing each other. The intermediate rails are then placed vertically between the outer rails and are attached to the outer rails at top and bottom as will be explained in further detail below. Then plaster boards or like wall plates are attached to the base of FIG. 1 so as to extend in the drawing plane. The plaster boards are screwed onto the underlying construction by means of self-tapping or self-cutting screws that are screwed through the plaster board and into a screw web of an intermediate rail and/or into a retention web of an outer rail. It is noted that each intermediate rail and outer rail of FIG. 1 may be assembled from a number of shorter rail portions positioned in continuation of each other or being provided telescopically in relation to each other.

The outer rail 1 is adapted for retaining two lateral screw webs 3, 4 of the intermediate rail 2. The intermediate rail 2 extends in a linear, vertical direction and has a C-shaped cross section. The two screw webs 3, 4 are connected to each other by means of a connecting portion 5, forming respective right angles so that the screw webs 3, 4 extend in parallel. The outer rail 1 extends in a longitudinal, horizontal direction and has a U-shaped cross section formed by a transverse connecting part 6 connecting two opposed lateral retention webs 7, 8, forming respective right angles with the connecting part 6 so that the retention webs extend in parallel. Each of the parts 3 to 8 are plate-shaped and plane, resulting from the fact that each of the rails 1, 2 are manufactured from one extruded metal profile that has been bent into shape. The bent corners may be slightly rounded.

Together, the two rails 1, 2 thus form elements of a sectional rail system for constructing the base for plate covering. The sectional rail system may also comprise further respective rails as well as other members for instance for constructing door and window openings.

Figure 6:
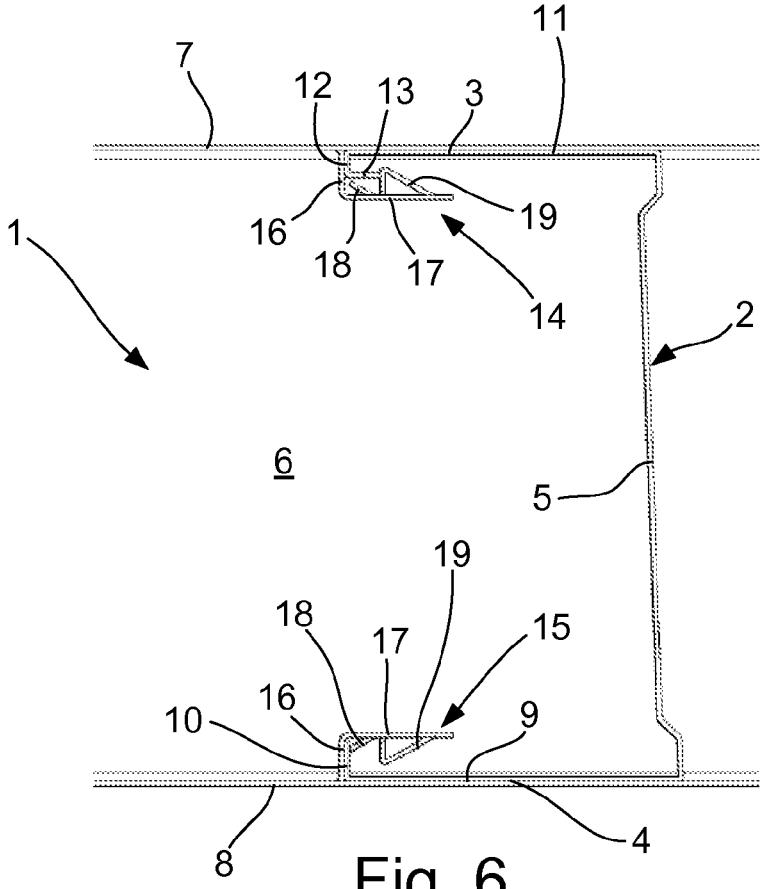
FIG. 6 is a top view of a portion of the outer rail of FIG. 2 with a first embodiment of an intermediate rail attached to it.
Figure 3:
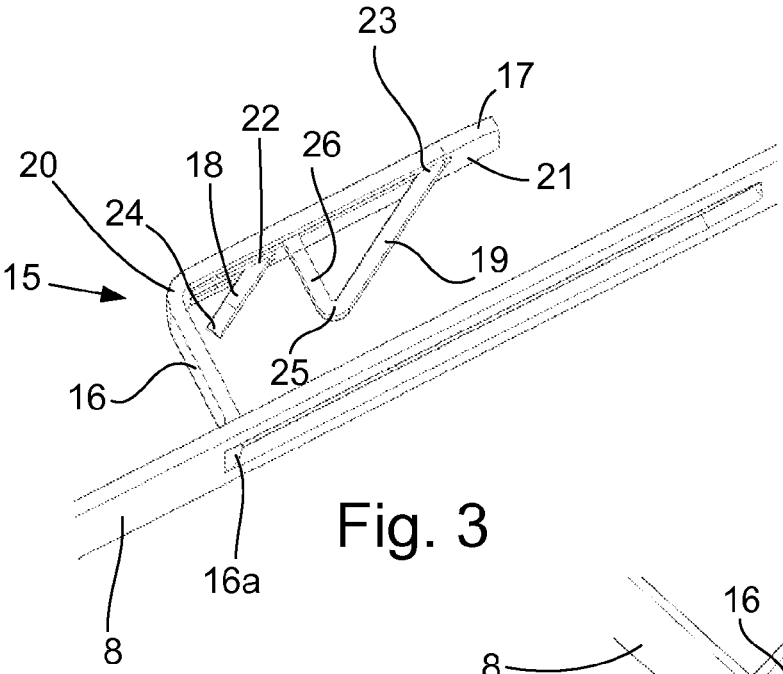
FIGS. 3 to 5 are different detailed perspective views of one of two retention devices of the outer rail of FIG. 2.
Figure 4:
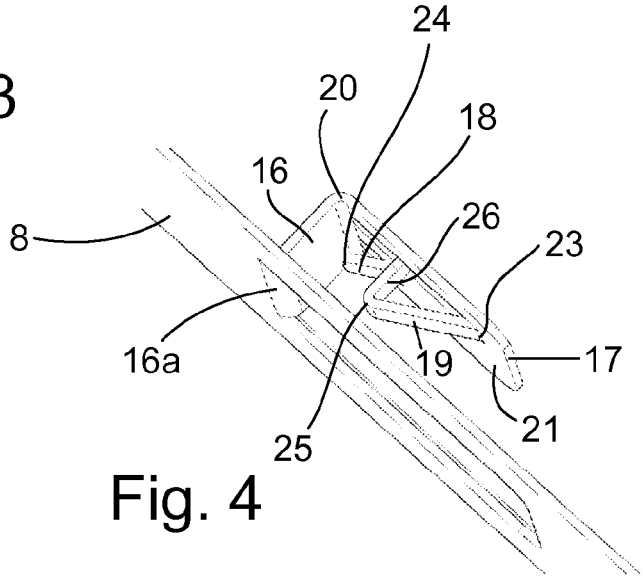
Figure 5:
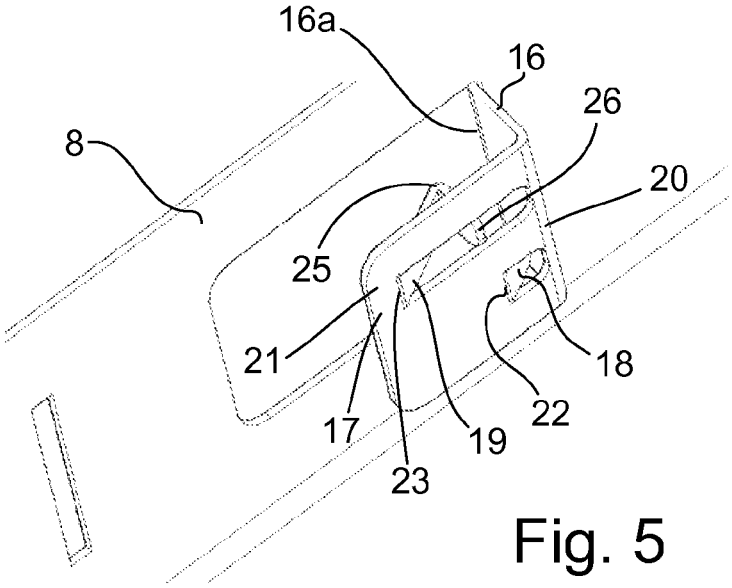

With the present embodiment of the intermediate rail 2 one screw web 4 has a first pre-defined configuration and the other screw web 3 has a second, different predefined configuration so that the intermediate rail 2 is asymmetrical in cross section, which is seen best in FIG. 6. Thus, the screw web 4 comprises a first flange 9 connected at a right angle to the connecting portion 5 and adapted to abut the retention web 8 along the longitudinal direction when the intermediate rail 2 is attached to the outer rail 1 as shown in FIG. 6. The first flange 9 then extends (bends) into a second flange 10 extending inwards at a right angle from the first flange 9. The screw web 3 similarly comprises a first flange 11 connected to the connecting portion 5 and adapted to abut the retention web 7 along the longitudinal direction when the intermediate rail 2 is attached to the outer rail 1. The first flange 11 then extends (bends) into a second flange 12 extending inwards at a right angle from the first flange 11. The flange 12 is shorter than (about half length of) the flange 10. The second flange 12 then extends (bends) at a right angle into a third flange 13 extending in the longitudinal direction such that the flanges 11 to 13 form a U-shape at a distal end of the screw web 3. Each of the flanges 9 to 13 are plate-shaped and form integral parts of the intermediate rail 2, i.e. the flanges are bent from the overall extruded profile of the intermediate rail 2.

As regards the outer rail 1 two retention devices 14, 15 are disposed oppositely on respective inner sides of each retention web 7, 6 for retaining a respective screw web 3, 4 of the intermediate rail 2. Note that the outer rail 1 comprises a number of further, similar retention devices positioned at intervals in the longitudinal direction for attachment of further intermediate rails, cf. FIG. 2.

The retention devices 14, 15 are identical, except from being mirrored in an imaginary centre plane parallel to and positioned in the middle between the retention webs 7, 8. For this reason, in the following only retention device 15, which is shown in more detail in FIGS. 3 to 5, will be described in detail.

Figure 7:
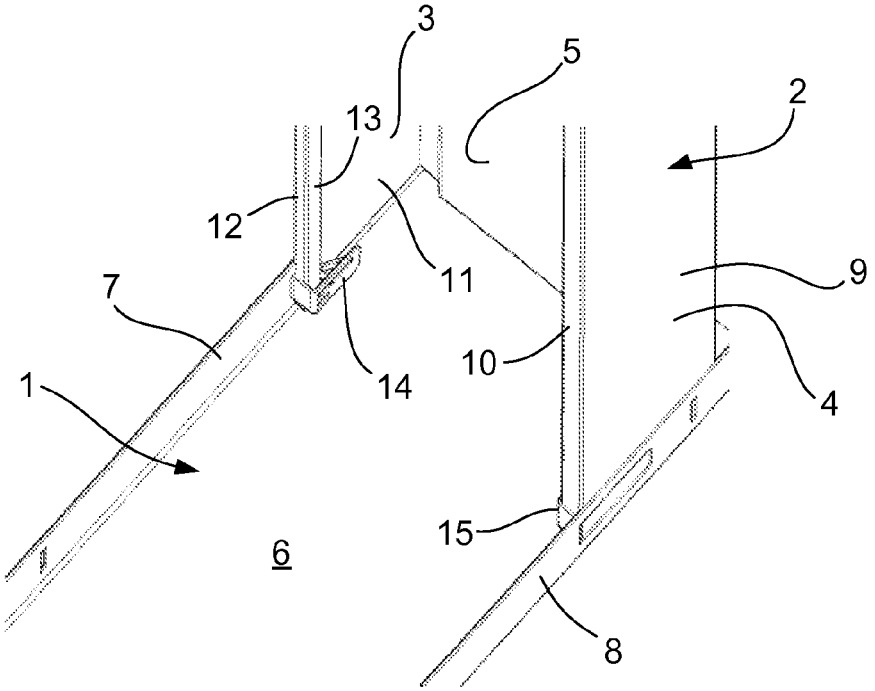
FIGS. 7 and 8 are different perspective views of the outer rail and attached intermediate rail according to FIG. 6.
Figure 8:
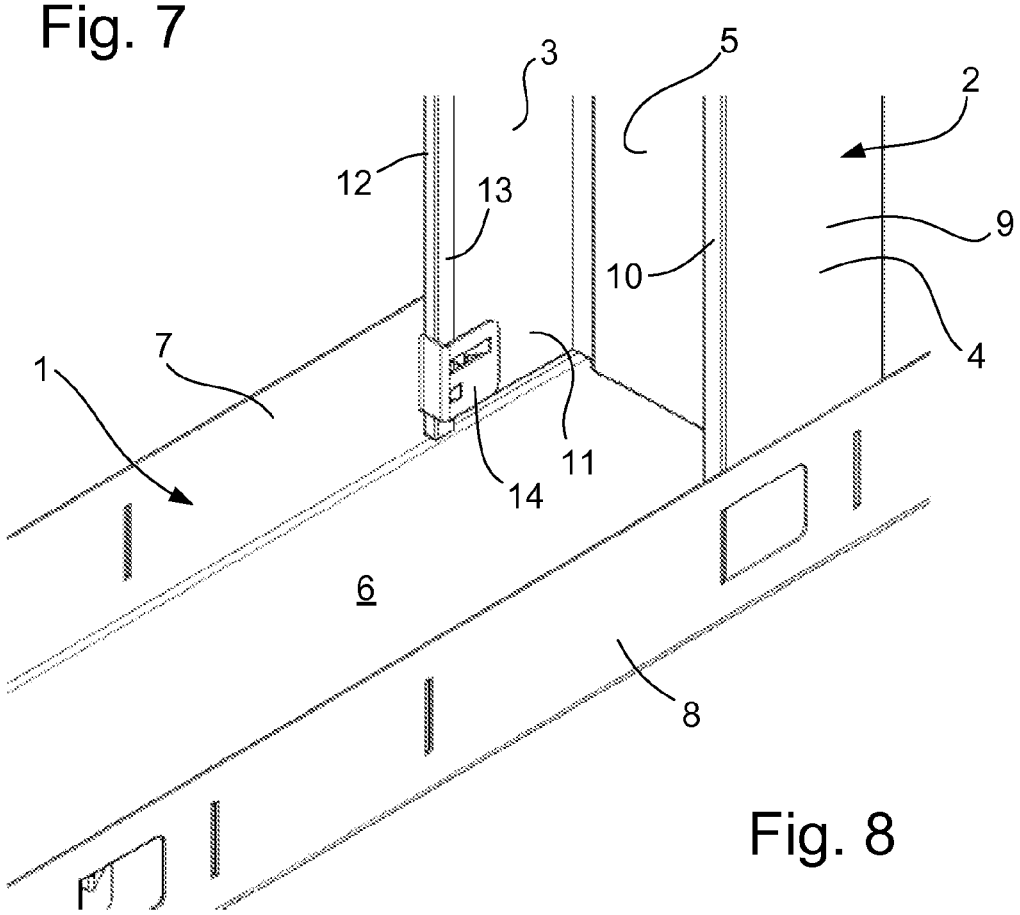
Figure 9:
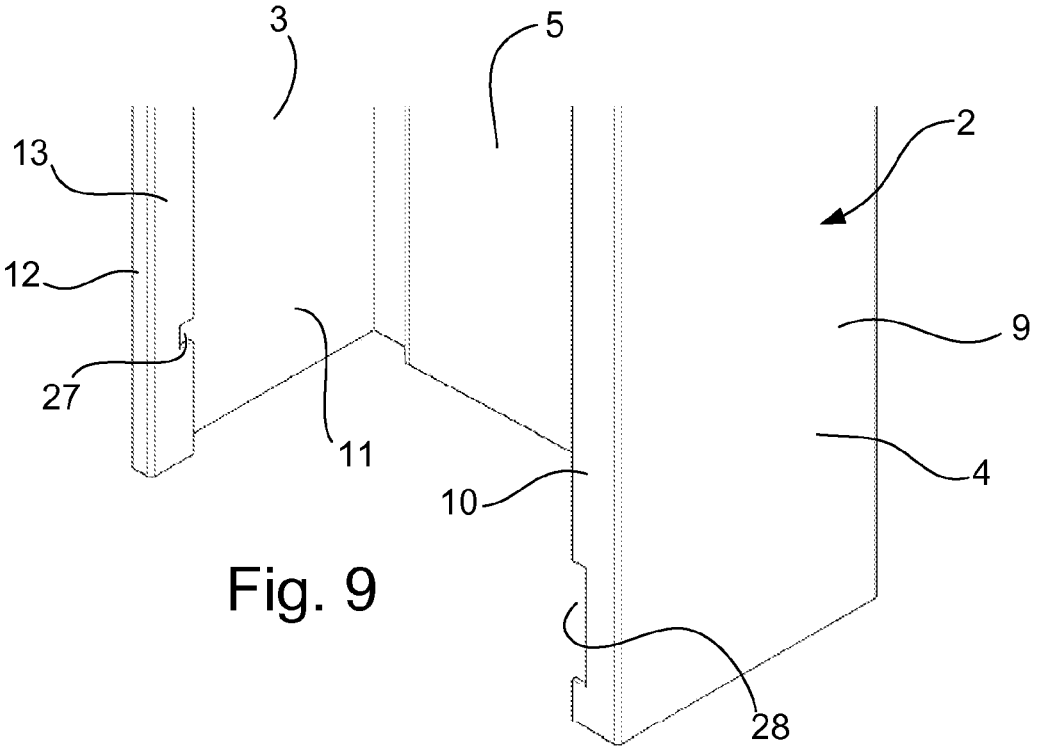
FIG. 9 is a perspective view of another embodiment of an intermediate rail.
Figure 10:
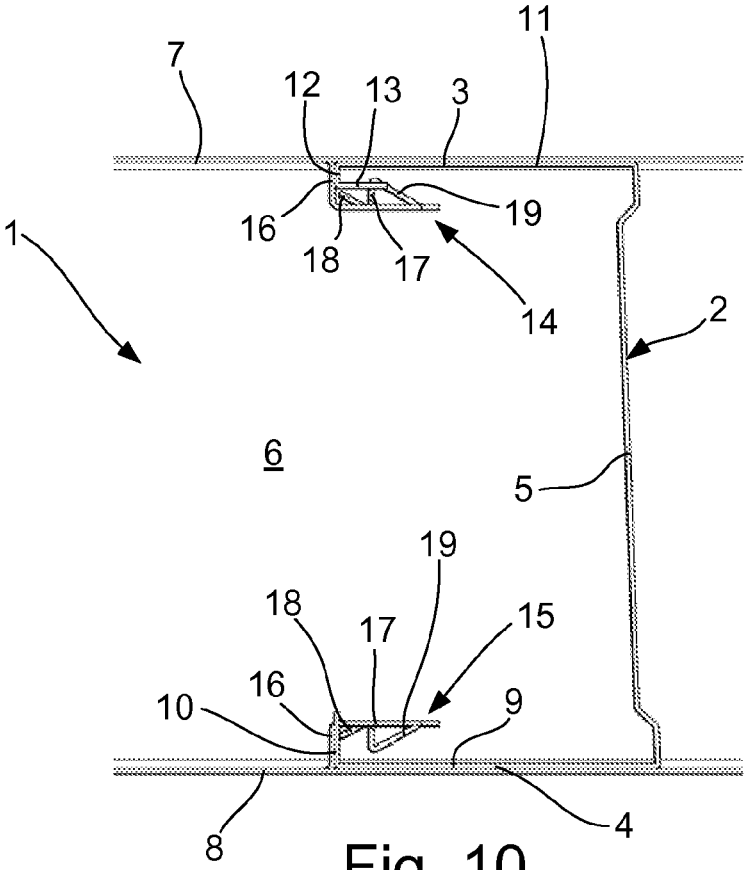
FIG. 10 is a top view corresponding to that of FIG. 6 of the intermediate rail of FIG. 9 attached to the outer rail of FIG. 2, FIGS. 11 and 12 are perspective views of respective details of FIG. 10 showing the attachment of the intermediate rail to the respective two retention devices of the outer rail.
Figure 11:
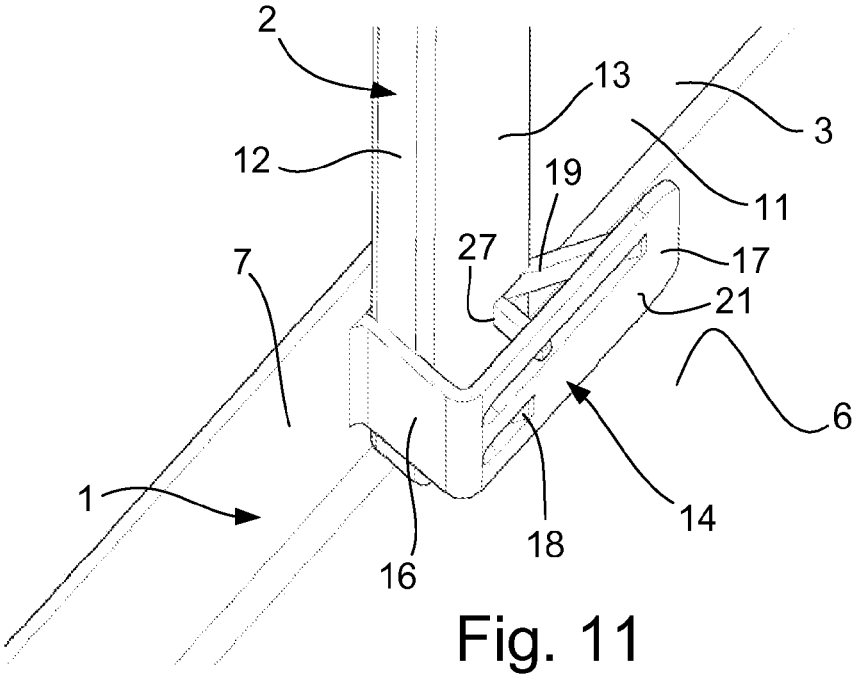
Figure 12:
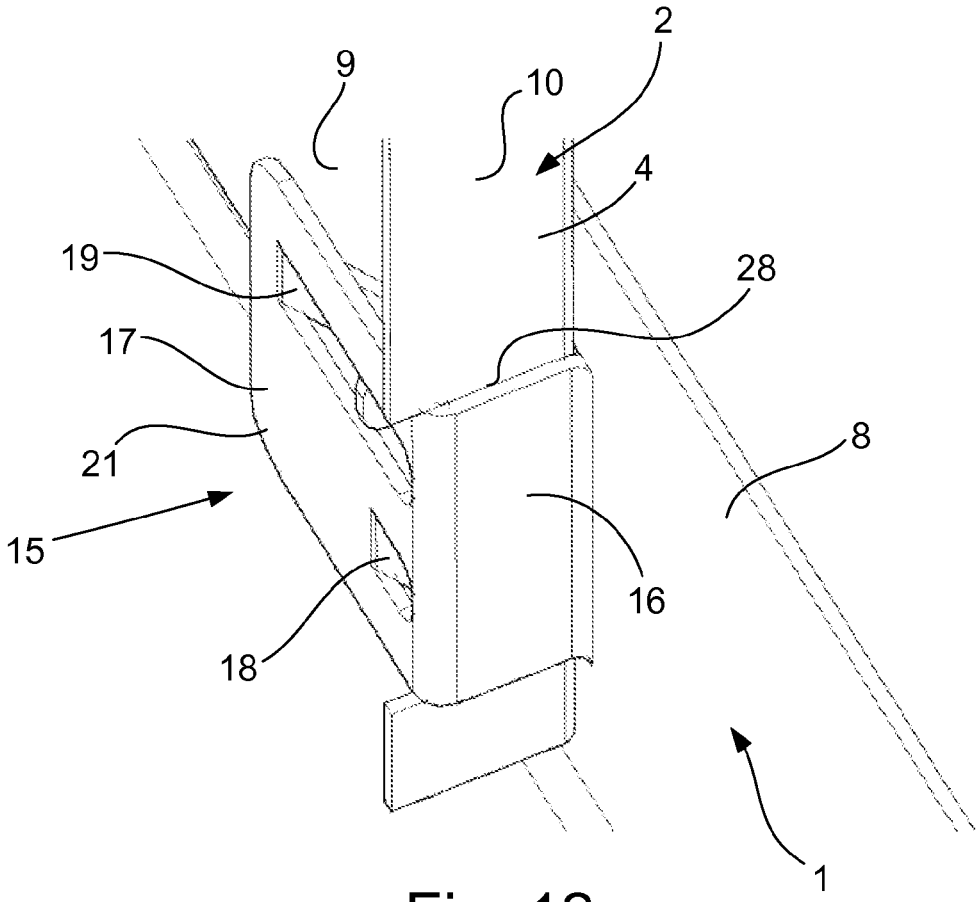
Figure 13:
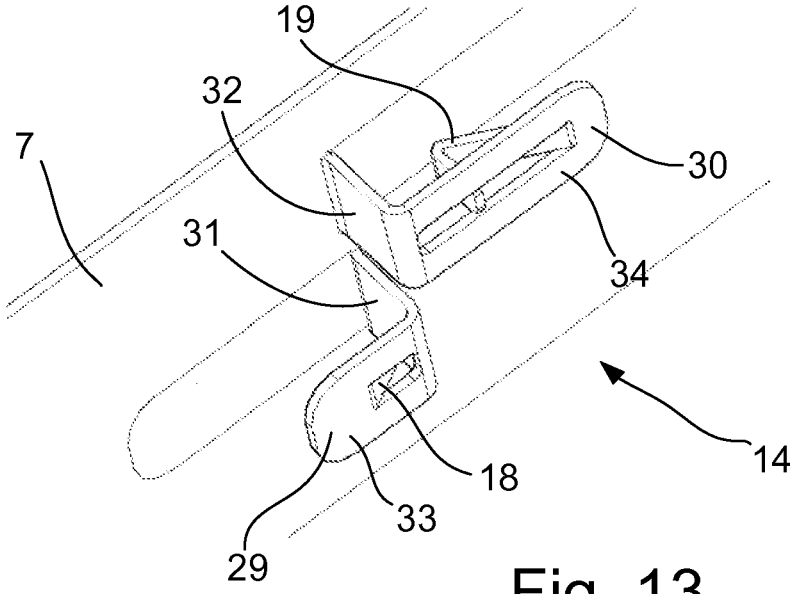
FIG. 13 is a perspective view of a detail of a second embodiment of the outer rail according to the invention showing a variation of the retention devices.
Figure 14:
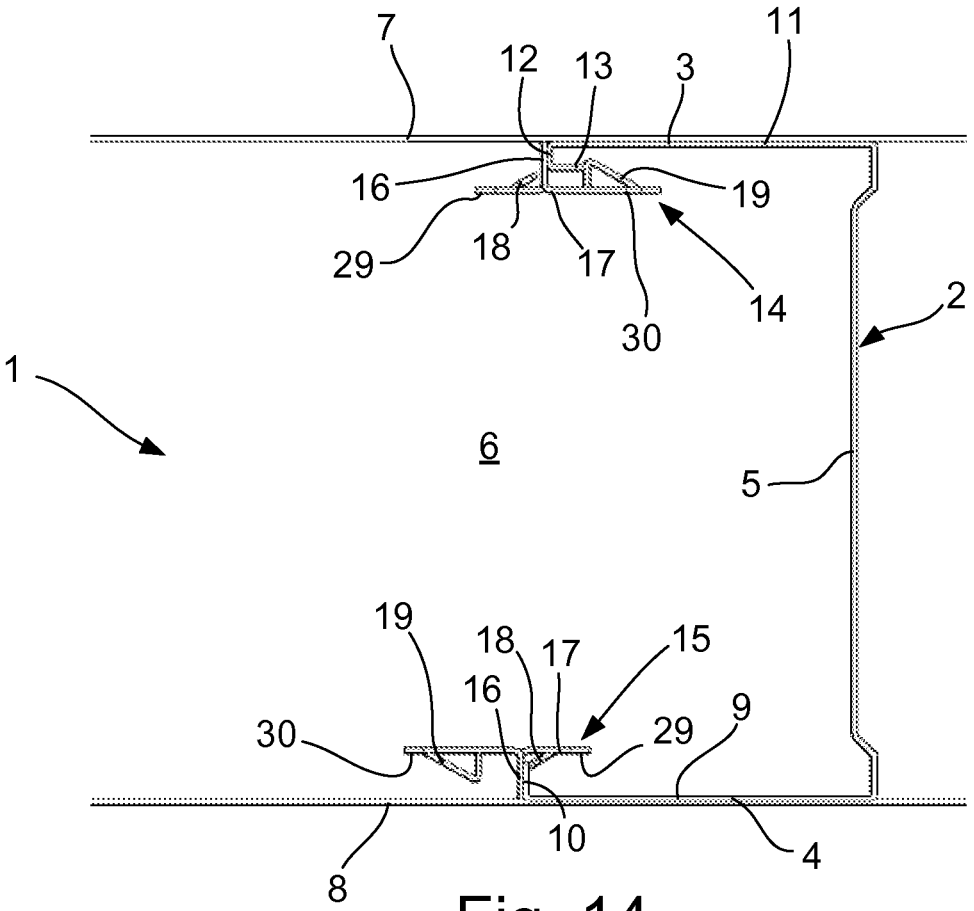
FIG. 14 is top view corresponding to that of FIG. 6 with the intermediate rail of FIG. 6 attached to the outer rail of FIG. 13, FIGS. 15 and 16 are perspective views of respective details of FIG. 14 showing attachment of the intermediate rail to the respective retention devices of the outer rail.
Figure 15:
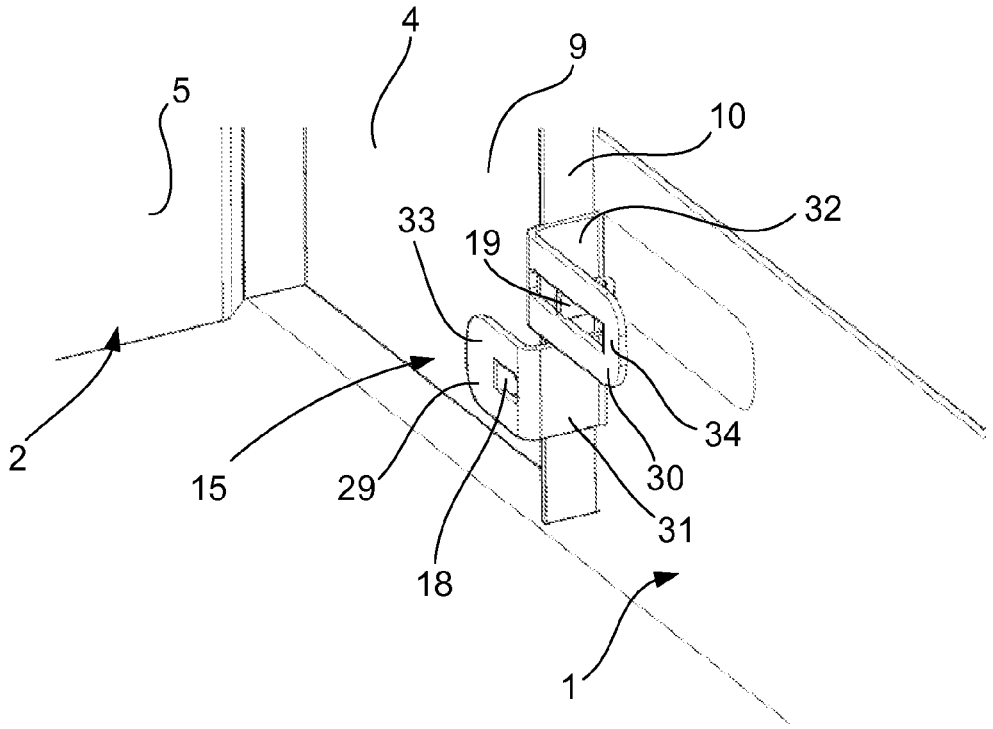
Figure 16:
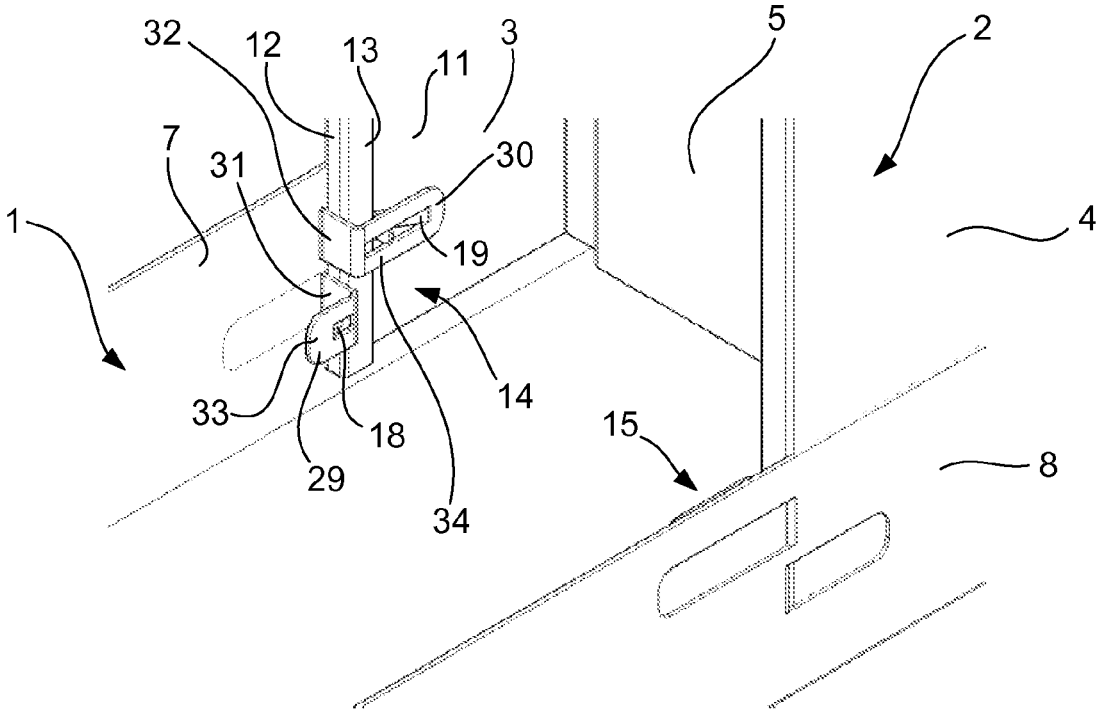

The retention device 15 includes an abutment part 16, which extends inwards at a right angle from the inner side of the retention web 8 such as to form an abutment surface for a screw web positioned to be retained in the retention device 15, cf. FIGS. 6 to 8. The retention device 15 extends further from the abutment part 16 into a locking part 17, which extends at a right angle to the abutment part 16 and is located at a distance from and in parallel with the associated retention web 8. The locking part 17 comprises a first resilient locking pin 18 adapted to lock a screw web configuration corresponding to that of the screw web 3 and a second, separate resilient locking pin 19 adapted to lock a screw web configuration corresponding to that of the screw web 4, cf. FIGS. 6 to 8. Each locking pin 18, 19 projects in an initial, unloaded position towards the associated retention web 8. Each locking pin 18, 19 is adapted to resiliently allow for passage of the respective pre-defined screw web configuration such that the screw web 3, 4 during passage pushes the locking pin 18 or 19, respectively, resiliently towards the locking part 17, the locking pin 18, 19 after passage resiliently assuming its initial position.

The abutment part 16 and locking part 17 are formed as one single cut-out from the associated retention web 8, the abutment part 16 being integral with the associated retention web 8 and bending inwards from a proximal end 16*a*, and at a distal end 20 bending in the longitudinal direction to extend integrally into the locking part 17. Similarly, the two locking pins 18, 19 are formed as tongues cut out in a flange 21 of the locking part 17, each tongue similarly being integral with the flange 21 at respective proximal ends 22, 23 and bending from the respective proximal ends 22, 23 such that each tongue forms an acute angle with the flange 21 and extends in an inclined direction towards the abutment part 16.

A distal end 24 of the first locking pin 18 is positioned near the abutment part 16 such as to be adapted to attach the flange 10 of a screw web configuration corresponding to that of screw web 4 between the distal end 24 and the abutment part 16. Similarly, a distal end 25 of the second locking pin 19 is formed as an abutment portion 26 that is bent inwards and positioned at a greater distance from the abutment part 16 such as to be adapted to attach the flange 13 of a screw web configuration corresponding to that of the screw web 3 between the abutment portion 26 and the abutment part 16.

Hereby, both screw web configurations (corresponding to screw webs 4 and 3, respectively) can be attached to any of the retention webs 7, 8 by sliding the screw web 4, 3 past an associated one of the locking pins 18, 19, after which the respective locking pin 18, 19 assumes its initial position to retain the respective screw web 4, 3 between the respective locking pin 18, 19 and abutment part 16. When the screw web 4, 3 is slid past the associated locking pin 18, 19, the locking pin 18, 19 resiliently moves inwards, more specifically rotates about the respective proximal end 22, 23. When the locking pin 19 moves inwards (i.e. away from the associated retention web 7, 8), the abutment portion 26 will move into the aperture left by the cut out tongue of the locking pin 19. When the screw web 4, 3 has passed the respective locking pin 18, 19, the resilience of the locking pins 18, 19 forces them back to the initial position, thus attaching the respective screw web 4, 3. Note that the overall purpose of the retention devices 14, 15, including locking pins 18, 19, is only to ensure that the screw webs 3, 4 are temporarily secured. The retention needs only to be able to absorb relatively small forces in a period of time until screws have been inserted to attach the base to the wall plates.

As is visible in the figures the locking pin 19 is positioned above the locking pin 18, i.e. at a greater distance from the connecting part 6, to provide room for both locking pins 18, 19.

FIGS. 9 to 12 show different views in which the shape of the intermediate rail 2 above has been varied. Only differences from the above embodiment of the intermediate rail 2 will be described in the following. More specifically, in the embodiment of FIGS. 9 to 12 the intermediate rail 2 has a specific configuration that is identical to that of the intermediate rail 2 described above, except from the fact that it comprises on each side a respective cut-out 27, 28. Both cut-outs 27, 28 are cut out at a distance from the bottom of the intermediate rail 2, this distance being suitable for ensuring their proper function as will be explained below. The cut-out 27 is cut out in the flange 13, and the cut-out 28 is cut out in the flange 10. Each cut-out 27, 28 corresponds in the height direction to the respective retention devices 14 and 15 so that when attached the intermediate rail 2 is also secured in the height direction, cf. FIGS. 10 to 12.

Note that with the retention device design used in the first embodiment of the outer rail 1 as shown in FIGS. 2 to 12 an asymmetric intermediate rail design as is shown in the drawings can optionally be turned upside down before attaching the intermediate rail 2 to the outer rail 1. This lessens the risk of errors during mounting and thus saves time. Furthermore, note that the retention device design used in the first embodiment may also be used with other designs of the intermediate rail 2. For example the intermediate rail 2 may comprise two identical (mirrored) screw web designs corresponding to the design of the screw web 3 as explained above, i.e. both comprising three flanges similar to flanges 11 to 13 in the above. Similarly, the intermediate rail 2 may comprise two identical (mirrored) screw web designs corresponding to the design of the screw web 4 as explained above, i.e. both comprising only two flanges similar to flanges 9 and 10 in the above. Also, several other intermediate rail designs could in principle be used.

FIGS. 13 to 16 show different views of a second embodiment of the outer rail 1 according to the invention showing a second embodiment of the retention devices 14, 15. In the following this second embodiment will be explained with reference to the retention device 14. The retention device 15 is similar to the retention device 14, but mirrored; similar to the previous embodiment. Only differences from the previous embodiment will be described in the following.

The retention device 14 comprises two separate retention device portions 29, 30, each having a separate abutment part portion 31, 32 and a separate locking part portion 33, 34. Corresponding to the above embodiment each retention device portion 29, 30 is formed as a cut-out from the respective retention web 7, 8; however, in this case as a separate cut-out. The respective locking part portions 33, 34 extend longitudinally in opposite directions from the respective abutment part portions 31, 32. The abutment part portions 31, 32 are positioned mutually coplanarly and above each other in a direction away from the connecting part 6. The locking part portion 33 comprises the first locking pin 18, and the locking part portion 34 comprises the second locking pin 19, the respective locking pins 18, 19 thus pointing in different directions, but otherwise each being designed similar to the first embodiment above. An intermediate rail 2 as described above, i.e. with asymmetrical cross section, can thus be snapped into attachment with the outer rail 2 from either side of the retention devices 14, 15. If the intermediate rail 2 is inserted from the opposite side from that shown in FIGS. 14 to 16, it is first rotated 180° about the vertical axis.

Note that the first embodiment of the outer rail 1 of FIGS. 2 to 12 could also be combined with the second embodiment of FIGS. 13 to 16 to provide a further embodiment with a retention device design that would be able to receive the intermediate rails according to the various designs as described above in relation to the first embodiment from both sides in the longitudinal direction. In this embodiment each retention device portion 29, 30 of FIGS. 14 to 16 would thus each comprise both first and second locking pins 18, 19.

Figure 2:
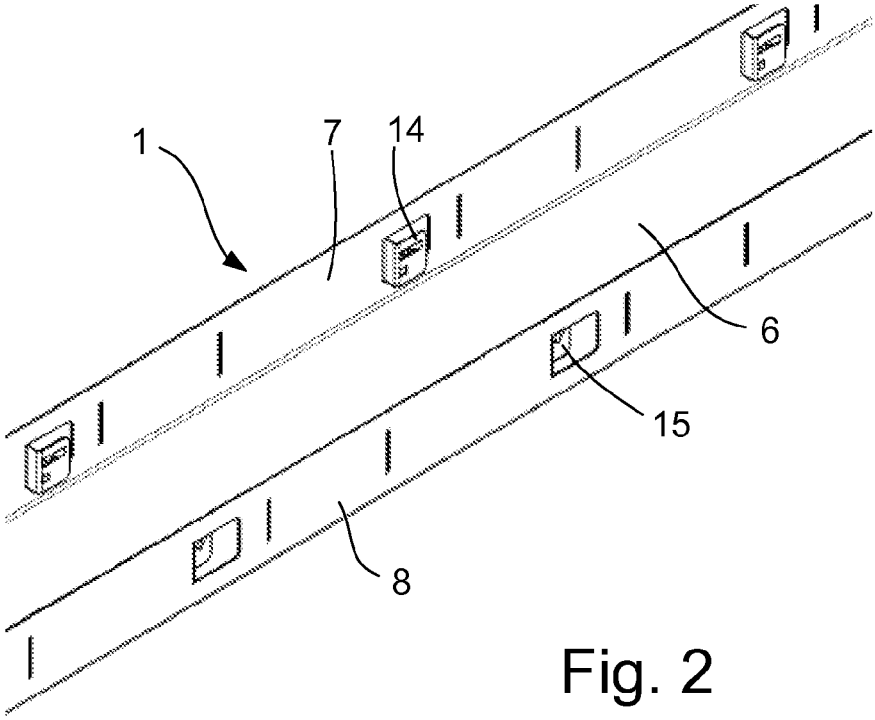
FIG. 2 is a perspective view of a portion of a first embodiment of an outer rail according to the invention.
Figure 17:
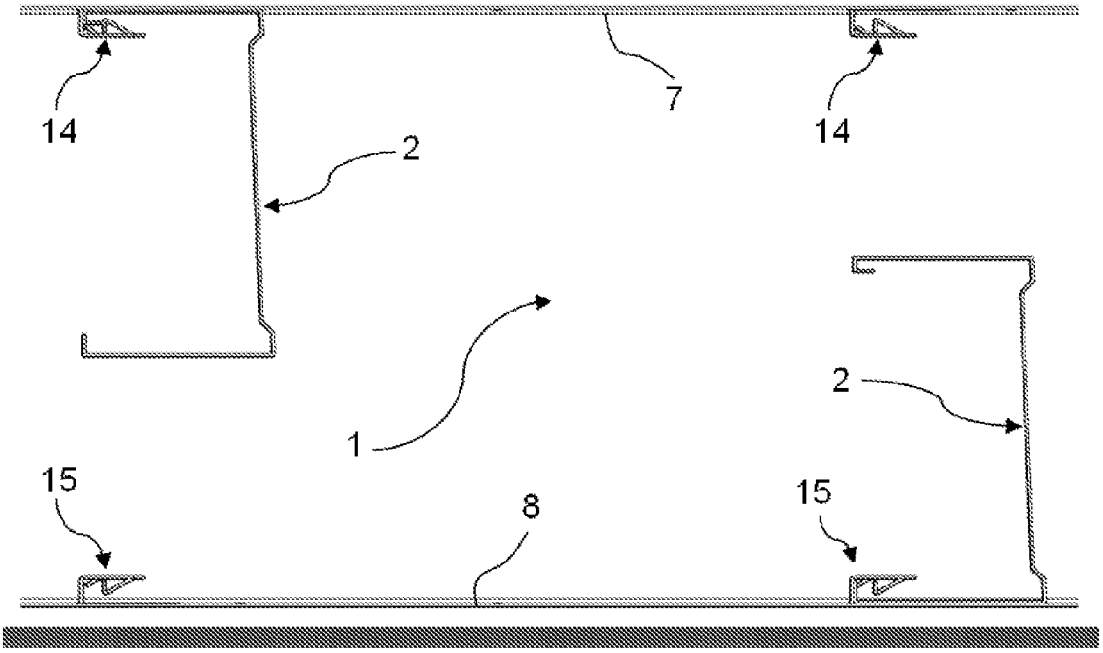
FIG. 17 is a top view corresponding to that of FIG. 6 showing an alternative assembly of the outer rail of FIG. 2 with the intermediate rail of FIG. 6.

FIG. 17 shows an alternative assembly of the outer rail of FIG. 2 with the intermediate rail of FIG. 6. In this embodiment the (each) intermediate rail 2 is only attached to one of the retention devices 14, 15, more specifically alternatingly to the retention device 14 and the retention device 15 along the length of the respective outer rail 1. To achieve this either the intermediate rail(s) 2 has (have) shorter widths or the outer rail(s) 1 has (have) larger widths. This embodiment is suitable for use is in internal walls, typically apartment dividers, when it is desired to reduce noise transmission between each side of the wall. Since the intermediate rail(s) 2 do not establish a mechanical connection, noise transmission through the intermediate rail 2 is reduced. Note that the strength and stiffness of the resulting wall base will be somewhat reduced, but can be made to be sufficient to correspond to the purpose of forming a framework for the resulting wall.

The invention claimed is:

1. An outer rail for retaining two lateral screw webs of an intermediate rail to construct a base for wall plate covering, the outer rail extending in a longitudinal direction and having a U-shaped cross section formed by a transverse connecting part connecting two opposed lateral retention webs, two retention devices being disposed oppositely on respective inner sides of each retention web for retaining a respective screw web of the intermediate rail, each retention device including an abutment part, which extends inwards from the inner side of the associated retention web such as to form an abutment surface for the respective screw web when the latter is positioned to be retained in the retention device, each abutment part extending into a locking part, which extends at an angle to the abutment part and at a distance from the respective retention web, each locking part comprising a first resilient locking pin adapted to lock a first screw web configuration and a second, separate resilient locking pin adapted to lock a second screw web configuration, the first and second screw web configurations being pre-defined and the first screw web configuration being different from the second screw web configuration, each locking pin projecting in an initial, unloaded position towards the locking pin's associated retention web, each locking pin being adapted to resiliently allow for passage of one of said first and second pre-defined screw web configurations such that the screw web during passage pushes the locking pin resiliently towards the locking part, the locking pin after passage resiliently assuming its initial position, such that a screw web corresponding to either of the first and second pre-defined screw web configurations can be attached to each of the retention webs by sliding the screw web past an associated one of the first and second locking pins of each respective retention device, after which the respective locking pin assumes its initial position to retain the respective screw web between the respective locking pin and abutment part.

2. An outer rail according to claim 1, wherein the abutment part and locking part of each retention device are formed as a cut-out from the retention web, the abutment part being integral with the associated retention web and bending inwards from a proximal end, and at a distal end bending in the longitudinal direction to extend integrally into the locking part, the abutment part preferably extending inwards substantially at a right angle to the retention web, the locking part preferably extending substantially at a right angle to the abutment part.

3. An outer rail according to claim 1, wherein the two locking pins of each retention device are formed as tongues cut out in a flange of the locking part, each tongue being integral with the flange at a proximal end and bending from the proximal end such that each tongue forms an acute angle with the flange and extends in an inclined direction towards the abutment part.

4. An outer rail according to claim 3, wherein for each locking part a distal end of the first locking pin is positioned near the abutment part such as to be adapted to attach an inwards extending flange of a first screw web configuration of an associated intermediate rail between the distal end of the first locking pin and the abutment part, and a distal end of the second locking pin is formed by an abutment portion that is bent inwards such as to be adapted to attach a flange extending in the longitudinal direction from an inwards extending flange of a second screw web configuration of an associated intermediate rail between the abutment portion and the abutment part.

5. An outer rail according to claim 1, wherein the first or second locking pin of each locking part is positioned above the other, i.e. at different distances from the connecting part.

6. An outer rail according to claim 1, wherein each locking part comprises two locking part portions, each extending in opposite directions from the abutment part and comprising one of the first and second locking pins.

7. An outer rail according to claim 6, wherein each locking part portion forms part of an associated retention device portion, which is formed as a separate cut-out from the respective retention web.

8. A sectional rail system for constructing a base for plate covering, comprising an outer rail according to any one of the previous claims, and an intermediate rail extending in a substantially linear direction and having a C-shaped cross section formed by a transverse connecting portion connecting two opposed lateral screw webs, both screw webs comprising a first flange connected to the connecting portion and adapted to abut the respective retention web of the outer rail to run parallel with this respective retention web in the longitudinal direction when the intermediate rail is attached to the outer rail, and a second flange extending inwards from and preferably substantially orthogonally to the respective first flange.

9. A sectional rail system according to claim 8, wherein one screw web of the intermediate rail has a first pre-defined configuration and the other has a second predefined configuration, the second configuration of the screw web of the intermediate rail being different from the first configuration of the screw web of the intermediate rail.

10. A sectional rail system according to claim 8, wherein an end flange of each of the first, second and third flanges of each screw web comprises a cut-out, the cut-outs being positioned at a distance from a bottom of the intermediate rail to correspond in a height to the respective retention devices of the outer rail when attached to the outer rail so that when the outer rail is attached to the intermediate rail, the intermediate rail is also secured in the height.

11. An outer rail according to claim 2, wherein the two locking pins of each retention device are formed as tongues cut out in a flange of the locking part, each tongue being integral with the flange at a proximal end and bending from the proximal end such that each tongue forms an acute angle with the flange and extends in an inclined direction towards the abutment part.

12. An outer rail according to claim 11, wherein for each locking part a distal end of the first locking pin is positioned near the abutment part such as to be adapted to attach an inwards extending flange of a first screw web configuration of an associated intermediate rail between the distal end of the first locking pin and the abutment part, and a distal end of the second locking pin is formed by an abutment portion that is bend inwards and positioned at a greater distance from the abutment part such as to be adapted to attach a flange extending in the longitudinal direction from an inwards extending flange of a second screw web configuration of an associated intermediate rail between the abutment portion and the abutment part.

13. A sectional rail system according to claim 9, wherein an end flange of each of the first, second and third flanges of each screw web comprises a cut-out, the cut-outs being positioned at a distance from a bottom of the intermediate rail to correspond in a height to the respective retention devices of the outer rail when attached to the outer rail so that when the outer rail is attached to the intermediate rail, the intermediate rail is also secured in the height.

* * * * *